US011661300B2

(12) United States Patent
Mizushima et al.

(10) Patent No.: US 11,661,300 B2
(45) Date of Patent: May 30, 2023

(54) MEDIUM TRANSPORTING APPARATUS, PROCESSING APPARATUS, AND RECORDING SYSTEM

(71) Applicant: SEIKO EPSON CORPORATION, Tokyo (JP)

(72) Inventors: Nobuyuki Mizushima, Shiojiri (JP); Kazuyoshi Ohashi, Matsumoto (JP); Akinori Muromachi, Matsumoto (JP); Kohei Ueno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 238 days.

(21) Appl. No.: 17/030,994

(22) Filed: Sep. 24, 2020

(65) Prior Publication Data

US 2021/0094786 A1 Apr. 1, 2021

(30) Foreign Application Priority Data

Sep. 26, 2019 (JP) ..... JP2019-175246

(51) Int. Cl.
*B65H 31/26* (2006.01)
*B65H 57/26* (2006.01)

(52) U.S. Cl.
CPC ..... *B65H 31/26* (2013.01); *B65H 57/26* (2013.01)

(58) Field of Classification Search
CPC ..... B65H 31/26; B65H 31/34; B65H 31/36
See application file for complete search history.

(56) References Cited

U.S. PATENT DOCUMENTS 5,938,192 A * 8/1999 Kosasa ..... B42C 1/12 271/223
2012/0025442 A1* 2/2012 Naraoka ..... B65H 33/08 270/58.27
2020/0172363 A1* 6/2020 Ueno ..... B65H 9/004
2021/0309481 A1* 10/2021 Shimada ..... B65H 31/36

FOREIGN PATENT DOCUMENTS

JP 2010-001149 1/2010

* cited by examiner

*Primary Examiner* — Howard J Sanders
(74) *Attorney, Agent, or Firm* — Workman Nydegger

(57) ABSTRACT

A medium transporting apparatus includes a mounting portion configured to mount a medium, and a pressing portion configured to switch between a first state for pressing the medium against the mounting portion and a second state for releasing the medium. The pressing portion takes the first state in waiting for the medium to the mounting portion, switches to the second state in response to the sent medium and returns to the first state after the medium is sent to the mounting portion. When the last medium is mounted on the mounting portion, a timing at which the pressing portion returns to the first state from the second state is delayed with respect to the timing of the return therebefore.

14 Claims, 11 Drawing Sheets

MEDIUM TRANSPORTING APPARATUS, PROCESSING APPARATUS, AND RECORDING SYSTEM

The present application is based on, and claims priority from JP Application Serial Number 2019-175246, filed Sep. 26, 2019, the disclosure of which is hereby incorporated by reference herein in its entirety.

BACKGROUND

1. Technical Field

The present disclosure relates to a medium transporting apparatus that transports a medium, a processing apparatus that includes the medium transporting apparatus, and a recording system that includes the processing apparatus.

2. Related Art

In processing apparatuses that perform a predetermined process on the medium, there is one that is configured to, after performing saddle stitching that binds a center of a plurality of stacked mediums to each other, form a booklet by folding the medium at a biding position.

Note that such a processing apparatus may be incorporated in a recording system configured to execute recording on a medium with a recording apparatus, a representative example being an ink jet printer, and saddle stitching and folding of the mediums, on which recording has been performed, in a continuous manner.

In such a processing apparatus, there is one that transports pre-process mediums to a mounting portion, on which the mediums are mounted, with a medium transporting apparatus, and performs saddle stitching after aligning the edge portions of the mediums mounted on the mounting portion by abutting the edge portions against the aligning portions.

For example, JP-A-2010-001149 discloses a configuration including a compiling tray corresponding to the mounting portion, an end guide corresponding to the aligning portions, paddles that move a sheet corresponding to the medium towards the end guide, and a pair of jogger fences that slide and move to align, in the width direction, the sheets piled up on the compiling tray.

In such a medium transporting apparatus described above, desirably, the stack of mediums is pressed against the mounting portion and the edges of the stack of mediums in the width direction, which is a direction intersecting the transport direction, are restricted so that the stack of mediums mounted on the mounting portion does not become disarranged. Furthermore, desirably, when the medium is sent onto the mounting portion, pressing of the stack of mediums towards the mounting portion is relieved for a minimum required time and the restriction towards the edges of the stack of mediums in the width direction is relieved.

Note that when sliding between the mediums are insufficient, as is the case, for example, in which ink jet printing is performed on the mediums and the frictional coefficient between the mediums are large, there are cases in which the downstream edge of the latest mounted medium in the transport direction does not reach the aligning portions and stops at an inappropriate position. However, in such cases as well, there are cases in which, the downstream edge of the medium, which has stopped at the inappropriate position, in the transport direction can reach the aligning portion by having the medium that has stopped at the inappropriate position be moved in the transport direction when the succeeding medium is sent. However, such an action cannot be expected to happen in the last medium of the plurality of mediums mounted on the mounting portion. Accordingly, there may be an incident in which a process is performed on the stack of mediums while the stack of mediums is not aligned in an appropriate manner.

SUMMARY

A medium transporting apparatus according to the present disclosure that overcomes the above issue includes a feeding member that transports a medium, a mounting portion that includes a support surface that, while being in an inclined position in which a downstream portion thereof is oriented downwards in a transport direction, supports the medium transported with the feeding member, the medium being mounted on the support surface, and a pressing portion configured to switch between a first state in which the pressing portion presses the medium, which is mounted on the mounting portion, from a downstream edge to a predetermined upstream area in the transport direction against the support surface, and a second state in which the pressing portion is, with respect to the first state, away from the support surface. In the medium transporting apparatus, when in a state waiting for the medium to be sent to the mounting portion, the pressing portion takes the first state, and when the medium is sent to the mounting portion, the pressing portion is switched to the second state from the first state and is returned to the first state from the second state after the medium is sent to the mounting portion, and in a case in which a plurality of mediums are mounted on the mounting portion, when a last medium is mounted on the mounting portion, a timing at which the pressing portion is returned to the first state from the second state is delayed with respect to a timing at which the pressing portion is returned to the first state from the second state when a medium before the last medium is mounted on the mounting portion.

DESCRIPTION OF EXEMPLARY EMBODIMENTS

Figure 1:
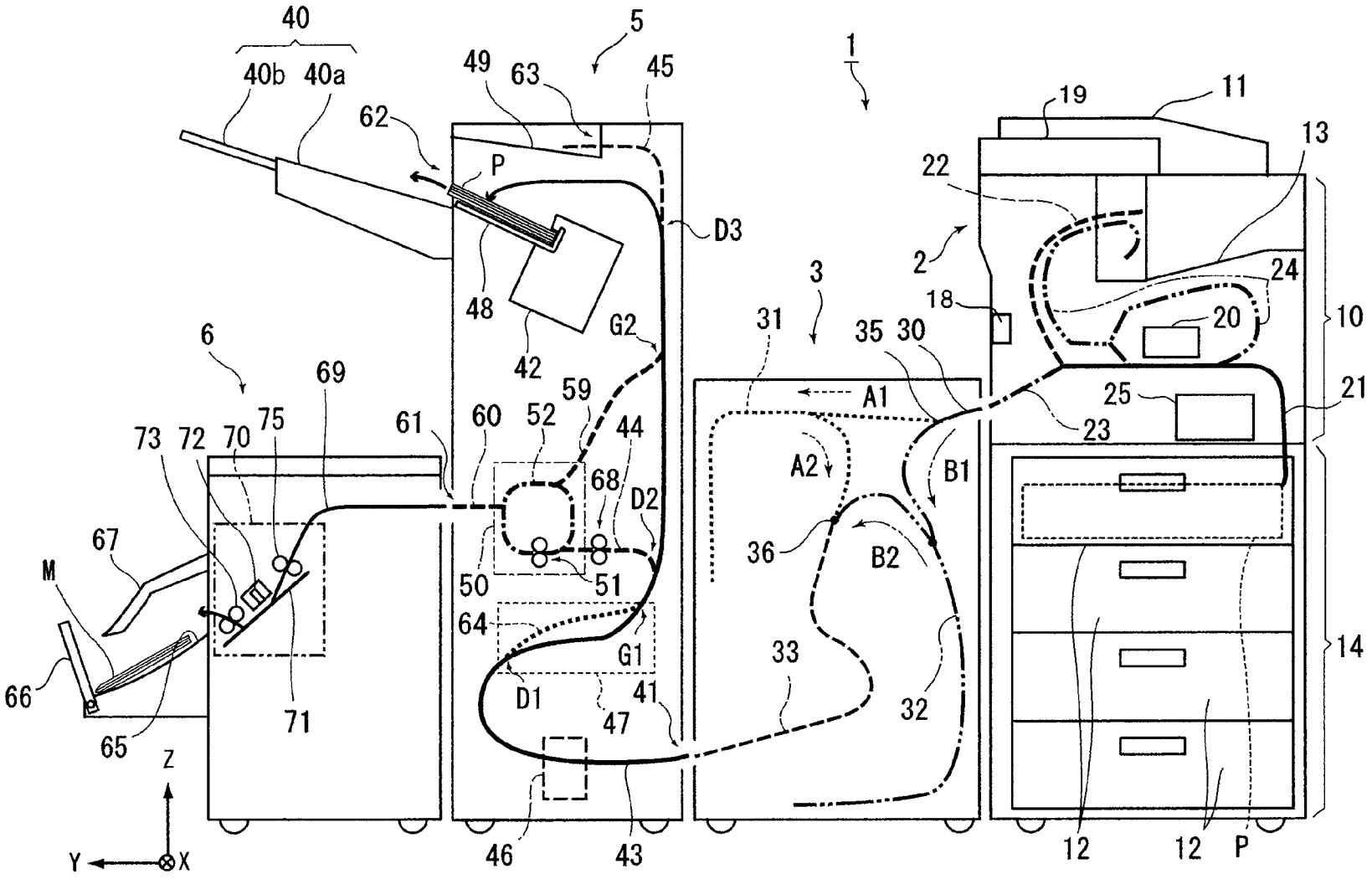
FIG. 1 is a diagram illustrating an overall configuration of a recording system.

Hereinafter, an outline of the present disclosure will be described.

A medium transporting apparatus according to a first aspect includes a feeding member that transports a medium, a mounting portion that includes a support surface that, while being in an inclined position in which a downstream portion thereof is oriented downwards in a transport direction, supports the medium transported with the feeding member, the medium being mounted on the support surface, and a pressing portion configured to switch between a first state in which the pressing portion presses the medium, which is mounted on the mounting portion, from a downstream edge to a predetermined upstream area in the transport direction against the support surface, and a second state in which the pressing portion is, with respect to the first state, away from the support surface. In the medium transporting apparatus, when in a state waiting for the medium to be sent to the mounting portion, the pressing portion takes the first state, and when the medium is sent to the mounting portion, the pressing portion is switched to the second state from the first state and is returned to the first state from the second state after the medium is sent to the mounting portion, and in a case in which a plurality of mediums are mounted on the mounting portion, when a last medium is mounted on the mounting portion, a timing at which the pressing portion is returned to the first state from the second state is delayed with respect to a timing at which the pressing portion is returned to the first state from the second state when a medium before the last medium is mounted on the mounting portion.

In other aspect, A medium transporting apparatus comprising: a feeding member configured to transport a medium; a mounting portion that includes a support surface configured to support and stack the medium transported with the feeding member, the support surface being in an inclined position in which a downstream portion thereof is oriented downwards in a transport direction; and a pressing portion configured to switch between a first state for pressing the medium against the support surface at a predetermined upstream area in the transport direction from a downstream edge of the medium, and a second state for being away from the support surface with respect to the first state, wherein the pressing portion is configured to take the first state in waiting for the medium to be sent to the mounting portion, switch to the second state from the first state when the medium is sent to the mounting portion, and return to the first state from the second state after the medium is sent to the mounting portion, and the pressing portion is configured to delay a timing to return to the first state for a last medium of a plurality of mediums mounted on the mounting portion with respect to a timing to return to the first state for a second medium from the last medium.

According to the present aspect, in a case in which the plurality of mediums are mounted on the mounting portion, when the last medium is mounted on the mounting portion, the timing at which the pressing portion is returned to the first state from the second state, in other words, the timing at which the mediums are pressed against the support surface, is delayed with respect to the timing at which the pressing portion is returned to the first state from the second state when the medium before the last medium is mounted on the mounting portion; accordingly, the downstream edge of the last medium can be aligned in a further reliable manner and, ultimately, a more appropriate aligning result can be obtained.

Furthermore, compared with when the delay in the timing is applied to all of the mediums mounted on the mounting portion, a decrease in throughput can be suppressed.

Note that in the present specification, "the last medium when the plurality of mediums are mounted on the mounting portion" refers to the medium positioned at the top of the stack of mediums when a process such as binding is performed on the stack of mediums mounted on the mounting portion, or refers to the medium at the top of the stack of mediums when the stack of mediums is discharged as it is to another location from the mounting portion without performing any process on the stack of mediums.

A second aspect according to the first aspect includes a first side guide that opposes a first edge of the medium, which is mounted on the mounting portion, in a width direction that is a direction intersecting the transport direction, and a second side guide that opposes a second edge of the medium. In the second aspect, the first side guide and the second side guide are configured to be displaced from an aligning position that aligns the edges of the medium in the width direction to a separated position in which the first side guide and the second side guide are, with respect to the aligning position, away from the edges of the medium. When in the state waiting for the medium to be sent to the mounting portion, the first side guide and the second side guide are in the aligning position, and when the medium is sent to the mounting portion, the first side guide and the second side guide are displaced to the separated position from the aligning position and, subsequently, are returned to the aligning position from the separated position. In the case in which the plurality of mediums are mounted on the mounting portion, when the last medium is mounted on the mounting portion, a timing at which the first side guide and the second side guide are returned to the aligning position from the separated position is delayed with respect to a timing at which the first side guide and the second side guide are returned to the aligning position from the separated position when the medium before the last medium is mounted on the mounting portion.

According to the present aspect, in a case in which the plurality of mediums are mounted on the mounting portion, when the last medium is mounted on the mounting portion, the timing at which the first side guide and the second side guide are returned to the aligning position from the separated position is delayed with respect to the timing at which the first side guide and the second side guide are returned to the aligning position from the separated position when the medium before the last medium is mounted on the mounting portion; accordingly, the edges in the width direction can be aligned while the downstream edge of the last medium is aligned in a further reliable manner and, ultimately, a more appropriate aligning result can be obtained.

In a third aspect according to the second aspect, the pressing portion returns to the first state from the second state after the first side guide and the second side guide return to the aligning position from the separated position.

According to the present aspect, since the pressing portion returns to the first state from the second state after the first side guide and the second side guide return to the aligning position from the separated position, the pressing portion does not impede the aligning of the mediums by the first side guide and the second side guide.

A fourth aspect according to the second or third aspect includes an aligning portion that aligns downstream edges of the mediums, which are mounted on the mounting portion, in the transport direction, and a moving member that is positioned between the feeding member and the aligning portion in the transport direction and that is disposed so as to oppose the support surface, the moving member moving the medium towards the aligning portion by rotation thereof while being in contact with the medium.

Since the present aspect includes the moving member that is positioned between the feeding member and the aligning portion in the transport direction and that is disposed so as to oppose the support surface and since the moving member moves the medium towards the aligning portion by rotation thereof while being in contact with the medium, the downstream edge of the medium can reach the aligning portion in a more reliable manner and, ultimately, a more appropriate aligning result can be obtained.

In a fifth aspect according to any one of the second to fourth aspects, the timing at which the pressing portion returns to the first state from the second state and the timing at which the first side guide and the second side guide return to the aligning position from the separated position are controlled according to a condition in which the medium is sent to the mounting portion.

According to the present aspect, since the timing at which the pressing portion returns to the first state from the second state and the timing at which the first side guide and the second side guide return to the aligning position from the separated position are controlled according to the condition in which the medium is sent to the mounting portion, the downstream edge of the medium can reach the aligning portion in a more reliable manner and, ultimately, a more appropriate aligning result can be obtained.

A processing apparatus according to a sixth aspect includes the medium transporting apparatus according to any one of the first to fifth aspects, and a processing portion that performs a process on a medium mounted on the mounting portion.

According to the present aspect, an advantageous effect of either one of the first to fifth aspects described above can be obtained in the processing apparatus.

A recording system according to a seventh aspect includes a recording unit that performs recording on a medium, and the processing apparatus according to the sixth aspect that receives the medium and performs a process on the medium on which recording has been performed with the recording unit.

According to the present aspect, an advantageous effect of the sixth aspect described above can be obtained in the recording system.

Hereinafter, the present disclosure will be described in detail.

The X-Y-Z coordinate system illustrated in each drawing is a rectangular coordinate system in which the X-axis direction is the apparatus depth direction, the Y-axis direction is the apparatus width direction, and the Z-axis direction is the apparatus height direction illustrating the vertical direction.

Outline of Recording System

A recording system 1 illustrated in FIG. 1 includes, as an example, from the right side towards the left side in FIG. 1, a recording unit 2, an intermediate unit 3, a first unit 5, and a second unit 6 serving as a processing apparatus that is detachable from the first unit 5.

The recording unit 2 performs recording on a transported medium. The intermediate unit 3 receives the medium, on which recording has been performed, from the recording unit 2 and delivers the medium to the first unit 5, and mainly functions to facilitate drying of the medium. A drying portion 50 that performs drying on the medium that has been received therein, and an edge binding portion 42 that stacks the mediums, on which recording has been performed in the recording unit 2, and that performs edge binding that binds the edges of the mediums are provided in the first unit 5. A saddle stitching and folding mechanism 70 that binds and folds a center of a stack of mediums, on which recording have been performed in the recording unit 2, into a booklet is provided in the second unit 6. Note that a process of binding the center of the stack of mediums, on which recording has been performed, and a subsequent process of folding the stack of mediums are referred to simply as "saddle stitching".

Hereinafter, the recording unit 2, the intermediate unit 3, the first unit 5, and the second unit 6 will be described in detail in the above order.

Regarding Recording Unit

The recording unit 2 is configured as a multifunction machine that includes a printer portion 10 including a line head 20 serving as a recording portion that performs recording on a medium, and a scanner portion 11. The line head 20 in the present exemplary embodiment is configured as a so-called ink jet recording head that performs recording by discharging ink, which is an example of a liquid, on a medium.

A cassette accommodation portion 14 that includes a plurality of medium storage cassettes 12 is provided below the printer portion 10. A recording operation is performed by having the medium P stored in the medium storage cassette 12 pass through a feeding path 21 depicted by a solid line and be sent to a recording area of the line head 20. The medium on which recording has been performed with the line head 20 is sent either to a first discharge path 22 that is a path through which the medium is discharged to a post-recording discharge tray 13 provided above the line head 20 or to a second discharge path 23 that is a path through which the medium is sent to the intermediate unit 3.

Referring to FIG. 1, the first discharge path 22 is depicted by a broken line and the second discharge path 23 is depicted by a dot and dash line. The second discharge path 23 is provided to extend in the +Y direction of the recording unit 2 and delivers the medium to a receiving path 30 of the adjacent intermediate unit 3.

Furthermore, the recording unit 2 includes a reversing path 24 depicted by a two-dot chain line in FIG. 1 and is configured to perform a double-sided recording that performs recording on a second surface of the medium after performing recording on a first surface and reversing the medium. One or more pairs of rollers (not shown) that are examples of members that transport the medium are disposed in each of the feeding path 21, the first discharge path 22, the second discharge path 23, and the reversing path 24.

A control unit 25 that controls operations related to the transport and recording of the medium in the recording unit 2 is provided in the recording unit 2. Note that the recording system 1 having the recording unit 2, the intermediate unit 3, the first unit 5, and the second unit 6 mechanically and electrically coupled to each other is configured to transport the medium from the recording unit 2 to the second unit 6. Note that the control unit 25 according to the present exemplary embodiment is configured to control various operations in the intermediate unit 3, the first unit 5, and the second unit 6 that are coupled to the recording unit 2.

The recording unit 2 includes an operation unit 19. The operation unit 19 is configured so that various settings and executed commands related to various processes in the recording unit 2, the intermediate unit 3, the first unit 5, and the second unit 6 are input therethrough. The operation unit 19 further includes a display panel (not shown) configured to display various pieces of information thereon.

Regarding Intermediate Unit

A description of the intermediate unit 3 will be given next. The intermediate unit 3 illustrated in FIG. 1 delivers the medium that the intermediate unit 3 has received from the recording unit 2 to the first unit 5. The intermediate unit 3 is disposed between the recording unit 2 and the first unit 5. The medium transported through the second discharge path 23 of the recording unit 2 is received into the intermediate unit 3 through the receiving path 30 and is transported towards the first unit 5. Note that the receiving path 30 is depicted by a solid line in FIG. 1.

In the intermediate unit 3, there are two transport paths that transport the medium. The first of the transport paths is a path that transports the medium from the receiving path 30, through a first switchback path 33 depicted by a dotted line in FIG. 1, and to the merging path 33. The second of the transport paths is a path that transports the medium from the receiving path 30, through a second switchback path 32 depicted by a two-dot chain line in FIG. 1, and to the merging path 33.

The first switchback path 31 is a path through which the medium is, after being received in an arrow A1 direction, switched back in an arrow A2 direction. The second switchback path 32 is a path through which the medium is, after being received in an arrow B1 direction, switched back in an arrow B2 direction.

The receiving path 30 is branched into the first switchback path 31 and the second switchback path 32 at a branching portion 35. A flap (not shown) that switches the destination of the medium to either the first switchback path 31 or the second switchback path 32 is provided in the branching portion 35.

Furthermore, the first switchback path 31 and the second switchback path 32 are merged at a merging portion 36. Accordingly, the medium sent through either the first switchback path 31 or the second switchback path 32 can be delivered from the receiving path 30 to the first unit 5 through the merging path 33 common to the first switchback path 31 and the second switchback path 32.

The intermediate unit 3 receives the medium from the recording unit 2 into the receiving path 30 while the latest recorded surface recorded with the line head 20 is faced upwards. The medium is flexed and reversed at the merging path 33 so that the latest recorded surface is facing down.

Accordingly, the medium in which the latest recorded surface is facing down is delivered to a first transport path 43 of the first unit 5 from the +Y direction of the intermediate unit 3.

Note that one or more pairs of rollers (not shown) serving as members that transport the medium are disposed in each of the receiving path 30, the first switchback path 31, the second switchback path 32, and the merging path 33.

When recording is performed continuously on a plurality of mediums in the recording unit 2, the mediums that have entered the intermediate unit 3 are alternately sent to the transport path passing through the first switchback path 31 and the transport path passing through the second switchback path 32. With the above, the medium transportation throughput in the intermediate unit 3 can be increased.

Furthermore, as in the line head 20 of the present exemplary embodiment in which a liquid, specifically ink, is discharged on the medium to perform recording, when processes are performed in the subsequent first unit 5 and second unit 6 while the medium is wet, the recording surface may become worn, or the mediums may become aligned in a defective manner.

By delivering the medium, on which recording has been performed, from the recording unit 2 to the first unit 5 through the intermediate unit 3, the time it takes for the medium on which recording has been performed to be sent to the first unit 5 can be set long and the medium can be dried further until the medium reaches the first unit 5 or the second unit 6.

Regarding First Unit

A description of the first unit 5 will be given next. The first unit 5 illustrated in FIG. 1 includes, at a lower portion thereof and in the −Y direction thereof, a receiving portion 41 that receives the medium from the intermediate unit 3. The medium that is transported through the merging path 33 of the intermediate unit 3 enters the first unit 5 through the receiving portion 41 and is delivered to the first transport path 43.

The first unit 5 includes a drying portion 50 that performs a process on the medium received through the receiving portion 41, and the edge binding portion 42 that performs a process on the medium received through the receiving portion 41 or on which a process has been performed in the drying portion 50.

The first unit 5 includes the first transport path 43 that sends the medium, which has been received through the receiving portion 41, to the edge binding portion 42, and a second transport path 44 that branches off from the first transport path 43 at a second branching portion D2 and that sends the medium to the drying portion 50. A flap (not shown) that switches the destination of the medium between the first transport path 43 and the second transport path 44 is provided in the second branching portion D2.

The edge binding portion 42 is a component that performs edge binding, which binds edge portions of the mediums such as, for example, a corner portion of each medium on one side, or one side of each medium. The edge binding portion 42 includes, as an example, a stapler.

The drying portion 50 is a component that performs drying on the medium. In the present exemplary embodiment, the drying portion 50 dries the medium by applying heat to the medium. While the detailed configuration of the drying portion 50 will be described later, the medium on which drying has been performed with the drying portion 50 is sent to either the edge binding portion 42 or the saddle stitching and folding mechanism 70 provided in the second unit 6.

Furthermore, the first unit 5 includes a punching portion 46 that performs punching on the medium that has been received through the receiving portion 41. The punching portion 46 is provided in the first transport path 43, through which the medium that has been received into the first unit 5 passes, at a position that is close to the receiving portion 41. The punching portion 46 is configured to perform punching at a position upstream of the first transport path 43. Note that punching does not have to be performed on the medium, which has been received through the receiving portion 41, with the punching portion 46.

The medium received through the receiving portion 41 can be, through the first transport path 43 illustrated in FIG. 1, sent to a processing tray 48 or to the second unit 6 described later. In the processing tray 48, the mediums are stacked on the processing tray 48 with rear edges thereof aligned in the transport direction. When a predetermined number of mediums P are stacked on the processing tray 48, the edge binding portion 42 can perform edge binding on the rear edges of the mediums P. The first unit 5 includes a second discharge portion 62 that discharges the medium in the +Y direction. Note that the first unit 5 includes, other than the second discharge portion 62, a first discharge portion 61 and a third discharge portion 63 that are also configured to discharge the medium.

The mediums on which a process has been performed by the edge binding portion 42 are discharged external to the first unit 5 through the second discharge portion 62 and are mounted on a first tray 40 that receives the medium discharged through the second discharge portion 62. The first tray 40 is provided so as to protrude in the +Y direction from the first unit 5. In the present exemplary embodiment, the first tray 40 includes a base portion 40*a* and an extension portion 40*b*. The extension portion 40*b* is configured to be accommodated in the base portion 40*a*.

Furthermore, a third transport path 45 that branches off from the first transport path 43 is coupled to the first transport path 43 at a third branching portion D3 downstream of the second branching portion D2. A flap (not shown) that switches the destination of the medium between the first transport path 43 and the third transport path 45 is provided in the third branching portion D3.

An upper tray 49 is provided at an upper portion of the first unit 5. The third transport path 45 continues from the third branching portion D3 to the third discharge portion 63 described above. The medium transported through the third transport path 45 is discharged onto the upper tray 49 through the third discharge portion 63 with a discharge member (not shown). In other words, the medium received through the receiving portion 41 can be discharged to the upper tray 49 without passing through the edge binding portion 42.

An overlapping path 64 that branches off from the first transport path 43 at a first branching portion D1 and that merges with the first transport path 43 at a first merging portion G1 is provided in the first transport path 43. The overlapping path 64 constitutes an overlap processing portion 47 that sets two mediums on top of the other and sends the mediums to the drying portion 50 or to the edge binding portion 42. A preceding medium and a succeeding medium can be transported downstream of the first merging portion G1 in an overlapped manner by sending the preceding medium that is precedingly transported to the overlapping path 64 and by merging the succeeding medium transported through the first transport path 43 and the preceding medium with each other at the first merging portion G1. Note that a plurality of overlapping paths 64 may be provided in the overlap processing portion 47 so that three or more mediums are overlapped on each other and sent downstream.

In the first unit 5, the overlap processing portion 47 is positioned vertically below the drying portion 50 and, when viewed in the vertical direction, or when viewed from the upper surface, the drying portion 50, the edge binding portion 42, and the overlap processing portion 47 have portions overlapping each other. Note that only the drying portion 50 and the overlap processing portion 47 may overlap each other, or only the edge binding portion 42 and the overlap processing portion 47 may overlap each other.

By disposing the drying portion 50, the edge binding portion 42, and the overlap processing portion 47 in such a positional relationship, an increase in the dimension of the apparatus in the horizontal direction can be suppressed and a reduction in the size of the apparatus can be achieved.

Note that one or more pairs of rollers (not shown) that are examples of members that transport the medium are disposed in each of the first transport path 43, the second transport path 44, and the third transport path 45 in the first unit 5.

A description of the drying portion 50 provided in the first unit 5 will be given next.

The drying portion 50 includes a pair of heat rollers 51 serving as a drying portion that performs drying on the medium, and a loop-shaped transport path 52 that includes the pair of heat rollers 51 and that is configured to circulate and transport the medium. The second transport path 44 that has branched off from the first transport path 43 merges with the loop-shaped transport path 52 at a portion upstream of the pair of heat rollers 51. Pair of transport rollers 68 provided in the second transport path 44 are configured to send and introduce the medium into the loop-shaped transport path 52.

In the pair of heat rollers 51 in the present exemplary embodiment, the lower roller is a driving dry roller that is driven by a drive source (not shown), and the upper roller is a driven dry roller that is driven and rotated by the rotation of the driving dry roller. The driving dry roller is heated with a heater (not shown) so that the driving dry roller radiates heat to perform drying on the medium. Note that it is only sufficient that either one of the rollers constituting the pair of heat rollers 51 is heated; however, both of the rollers may be heated.

Note that the medium sent from the intermediate unit 3 enters through the receiving portion 41 of the first unit 5, passes through the first transport path 43 into the second transport path 44 while the latest recorded surface is facing down. Subsequently, the medium is nipped between the pair of heat rollers 51 while the latest recorded surface is facing down. Accordingly, among the pair of heat rollers 51, desirably, the heated roller comes in contact with the latest recorded surface of the medium.

The drying portion includes the loop-shaped transport path 52 and is configured to circulate and transport the medium in the loop-shaped transport path 52; accordingly, by circulating and transporting the medium a plurality of times, drying with the pair of heat rollers 51 can be performed a plurality of times. Accordingly, drying of the medium can be performed in a further reliable manner.

Furthermore, compared, for example, with when a plurality of pairs of heat rollers 51 are provided in the transport path, an increase in the cost of the apparatus can be suppressed and power consumption can be suppressed by including the loop-shaped transport path 52.

In the recording system 1, the heating with the pair of heat rollers 51 is controlled by the control unit 25 provided in the recording unit 2. The control unit 25 is configured to control the heating of the pair of heat rollers 51 according to conditions. The conditions include, for example, other than the type, the stiffness, the thickness, the basis weight, and the like of the medium, the discharged amount of ink discharged while the recording unit 2 performed recording on the medium, whether recording on the medium is a double-sided recording or a single-sided recording, the environmental conditions such as the temperature, humidity, and the like when drying.

By controlling the heating by the pair of heat rollers 51 in accordance with such conditions, the medium can be dried in a more appropriate manner. The control of heating by the pair of heat rollers 51 includes, for example, whether heating is performed, the temperature when heating is performed, whether the remaining heat is used when heating is performed, the timing at which the pair of heat rollers 51 start heating, and the like.

Furthermore, in the pair of heat rollers 51, one of the heat rollers, that is, the driven dry roller is urged against the other heat roller, that is, the driving dry roller with an urging member (not shown) such as a spring. The urging member is configured to change the urging force. The nip pressure of the pair of heat rollers 51 can be controlled by having the control unit 25 control an urging force changing member (not shown) that changes the urging force of the urging member. Desirably, the nip pressure of the pair of heat rollers 51 is changed according to conditions. Conditions that are similar to the conditions when controlling the heating by the pair of heat rollers 51 can be used.

A fourth transport path 59 is coupled to the loop-shaped transport path 52. The fourth transport path 59 is a path that merges with the first transport path 43 at a second merging portion G2 and that returns the medium, to which the drying has been performed with the pair of heat rollers 51, to the first transport path 43.

Furthermore, a fifth transport path 60 is coupled to the loop-shaped transport path 52. The fifth transport path 60 is a path continuous to the first discharge portion 61, and is a path that sends out the medium on which drying has been performed by the pair of heat rollers 51 towards the second unit 6.

Furthermore, the first unit 5 includes a changeover flap (not shown) configured to switch between a first state in which the medium on which a process has been performed in the drying portion 50 is sent to the first discharge portion 61 and a second state in which the medium on which the process has been performed in the drying portion 50 is sent to the edge binding portion 42.

Note that the drying portion 50 can be configured without the loop-shaped transport path 52.

Furthermore, while in the present exemplary embodiment, the description has been given of the drying portion 50 that dries the medium by heating the medium from the outside, the drying portion 50 can be configured to dry the medium by applying air against the medium, for example.

Regarding Second Unit

A description of the second unit 6 will be given next.

The second unit 6 is provided below the first tray 40 of the first unit 5 so as to be detachable from the first unit 5.

The medium delivered through the first discharge portion 61 of the first unit 5 to the second unit 6 is transported through a transport path 69 and is sent to the saddle stitching and folding mechanism 70. The saddle stitching and folding mechanism 70 includes a stacking portion 71 serving as a mounting portion on which the medium is mounted. The stack of mediums mounted on the stacking portion 71 can be, after being bound at a saddle stitching position, folded at the saddle stitching position to be formed as a booklet.

The stack of mediums M, on which saddle stitching has been performed with the saddle stitching and folding mechanism 70, is discharged to a second tray 65 illustrated in FIG. 1. The second tray 65 includes, at a distal end thereof in the +Y direction that is a medium discharge direction, a restriction portion 66. The restriction portion 66 prevents the stack of mediums M discharged to the second tray 65 from protruding from the second tray 65 in the medium discharge direction or prevents the stack of mediums M from dropping off from the second tray 65. Reference numeral 67 is a guide portion 67 that guides the stack of mediums M discharged from the second unit 6 to the second tray 65.

Subsequently, referring mainly to FIGS. 2 and 7, the configuration of the saddle stitching and folding mechanism 70 will be described further. Note that hereinafter, a single medium will be referred to as a medium P, and a stack of mediums formed of a plurality of mediums P mounted on the stacking portion 71 will be referred to as a stack of mediums M.

Figure 2:
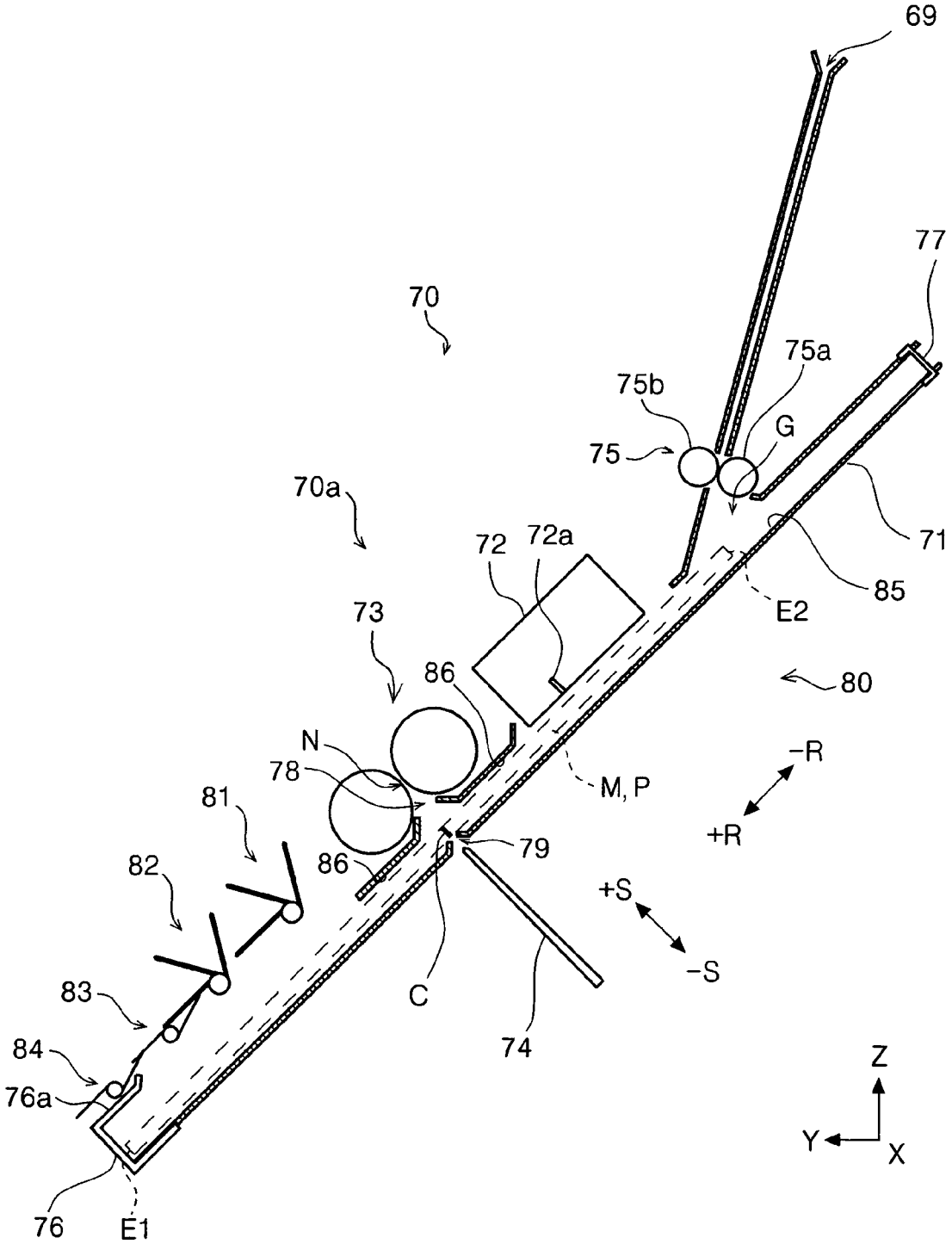
FIG. 2 is a side view of a saddle stitching and folding mechanism.

Referring to FIG. 2, the saddle stitching and folding mechanism 70 includes a medium transporting apparatus 80 and a processing portion 70*a*. The medium transporting apparatus 80 includes a pair of feed rollers 75 that are provided in the transport path 69 and that serve as a feeding member that transports the medium P, and the stacking portion 71 serving as a mounting portion on which the mediums P transported by the pair of feed rollers 75 are stacked. The processing portion 70*a* includes a binding mechanism 72 that, at a binding position, binds the stack of mediums M mounted on the stacking portion 71, and a pair of folding rollers 73 serving as a folding member that folds the stack of mediums M at the binding position.

The pair of feed rollers 75 includes a driving roller 75*a* driven by a drive source (not shown), and a driven roller 75*b* driven and rotated by the rotation of the driving roller 75*a*. The driving roller 75*a* rotates while being controlled by the control unit 25 (see FIG. 1).

The reference sign G in FIG. 2 indicates a merging position G, which is where the transport path 69 and the stacking portion 71 merge with each other. The medium P is sent from the transport path 69 to the stacking portion 71 with the pair of feed rollers 75.

The stacking portion 71 includes a support surface 85 that supports the medium P transported by the pair of feed rollers 75 while being in a position in which downstream thereof in a transport direction +R is oriented downwards. The stacking portion 71 receives and stacks the mediums P between the support surface 85 and an opposing surface 86 that opposes the support surface 85.

Figure 7:
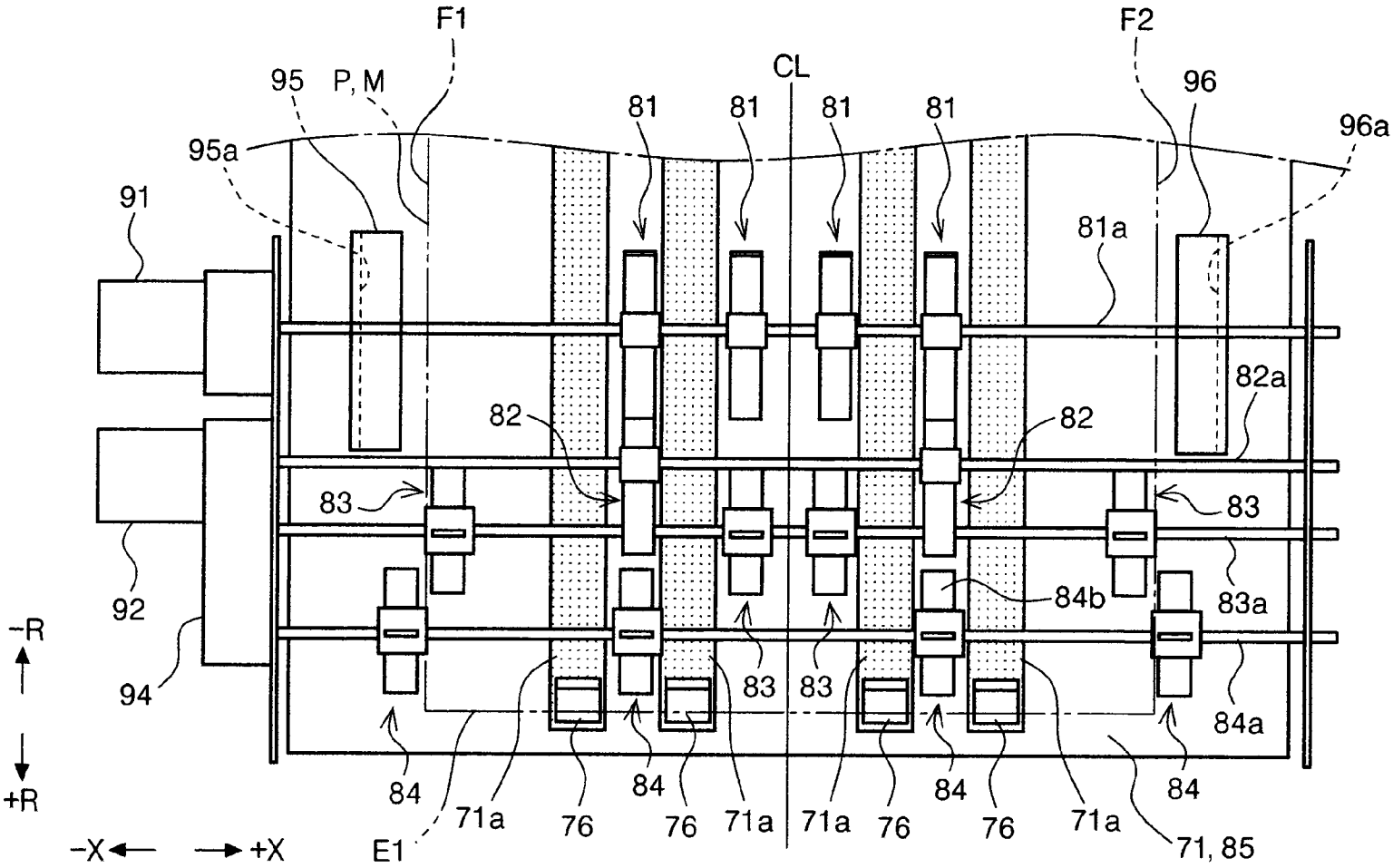
FIG. 7 is a plan view of a medium transporting apparatus.

Furthermore, as illustrated in FIGS. 2 and 7, the medium transporting apparatus 80 includes aligning portions 76 that align downstream edges E1 of a plurality of mediums P stacked on the stacking portion 71, a first side guide 95 that opposes edges F1 of the mediums P, which are stacked on the stacking portion 71, in the −X direction, a second side guide 96 that opposes edges F2 of the mediums P, which are stacked on the stacking portion 71, in the +X direction, first paddles 81 and second paddles 82 that send the medium P in the transport direction +R, and first auxiliary paddles 83 and second auxiliary paddles 84 that assist the above paddles in sending the medium P.

The first paddles 81 are paddles positioned downstream of the pair of feed rollers 75 and are the first of the paddles positioned downstream of the pair of folding rollers 73 in the transport direction +R. The first paddles 81 are disposed so as to oppose the support surface 85 of the stacking portion 71.

The second paddles 82 are positioned downstream of the first paddles 81 in the transport direction +R and are disposed so as to oppose the support surface 85 of the stacking portion 71.

While being in contact with the medium P, the first paddles 81 and the second paddles 82 rotate in the clockwise direction in FIG. 2 to move the medium P towards the aligning portions 76. The first paddles 81 and the second paddles 82 rotate while being controlled by the control unit 25 (see FIG. 1).

The first auxiliary paddles 83 are positioned downstream of the second paddles 82 in the transport direction +R and are disposed so as to oppose the support surface 85 of the stacking portion 71.

The second auxiliary paddles 84 are positioned downstream of the first auxiliary paddles 83 in the transport direction +R and are disposed so as to oppose the support surface 85 of the stacking portion 71.

The first auxiliary paddles 83 and the second auxiliary paddles 84 rotate in a direction that is the same as that of the first paddles 81 and the second paddles 82 described above, in other words, the first auxiliary paddles 83 and the second auxiliary paddles 84 rotate in the clockwise direction in FIG. 2 to restrict the medium P from lifting from the support surface 85. The first auxiliary paddles 83 and the second auxiliary paddles 84 rotate while being controlled by the control unit 25 (see FIG. 1).

Note that when there is no particular need to distinguish between the first paddles 81, the second paddles 82, the first auxiliary paddles 83, and the second auxiliary paddles 84 from each other, the above will be, for convenience sake, referred to hereinafter as a "paddle group".

The aligning portions 76 configured to abut against the downstream edges E1 of the mediums P, and abutting portions 77 configured to abut against upstream edges E2 of the mediums P are provided in the stacking portion 71. The aligning portions 76 and the abutting portions 77 are configured to move in both the transport direction +R and a direction −R opposite the transport direction +R with a driving member (not shown).

The aligning portions 76 align the downstream edges E1 of the mediums P, and the abutting portions 77 align the upstream edges E2 of the mediums P. The aligning portions 76 and the abutting portions 77 can be moved in the transport direction +R and the opposite direction −R using, for example, a rack and pinion mechanism, a belt moving mechanism, or the like that is operated by motive power of a drive source (not shown).

Furthermore, pressing portions 76*a* that press the mediums P from the downstream edges E1 to a predetermined upstream area against the support surface 85 is integrally formed in the aligning portions 76. The pressing portions 76*a* are configured to switch between a first state (FIGS. 3 and 4) in which the pressing portions 76*a* press the stack of mediums M from the downstream edges E1 to the predetermined upstream area against the support surface 85 with motive power of a drive source (not shown), and a second state (FIGS. 2, 5, and 6) in which the pressing portions 76*a* are, with respect to the first state, away from the support surface 85. Note that for convenience sake, hereinafter, the first state of the pressing portions 76*a* will be referred to as a "closed state", and the second state will be referred to as an "open state".

The aligning portions 76, the pressing portions 76*a*, and the abutting portions 77 are controlled by the control unit 25 (see FIG. 1).

Referring to FIG. 7, as described above, the first side guide 95 that opposes the edges F1 in the −X direction of the mediums P stacked on the stacking portion 71, and the second side guide 96 that opposes the edges F2 in the +X direction of the mediums P stacked on the stacking portion 71 are provided in the stacking portion 71. The first side guide 95 and the second side guide 96 are configured to move in the X-axis direction, which is a width direction of the medium P in the stacking portion 71, with a driving member (not shown). The first side guide 95 and the second side guide 96 can be moved in the −X direction and the +X direction using, for example, a rack and pinion mechanism, a belt moving mechanism, or the like that is operated by motive power of a drive source (not shown).

Figure 9:
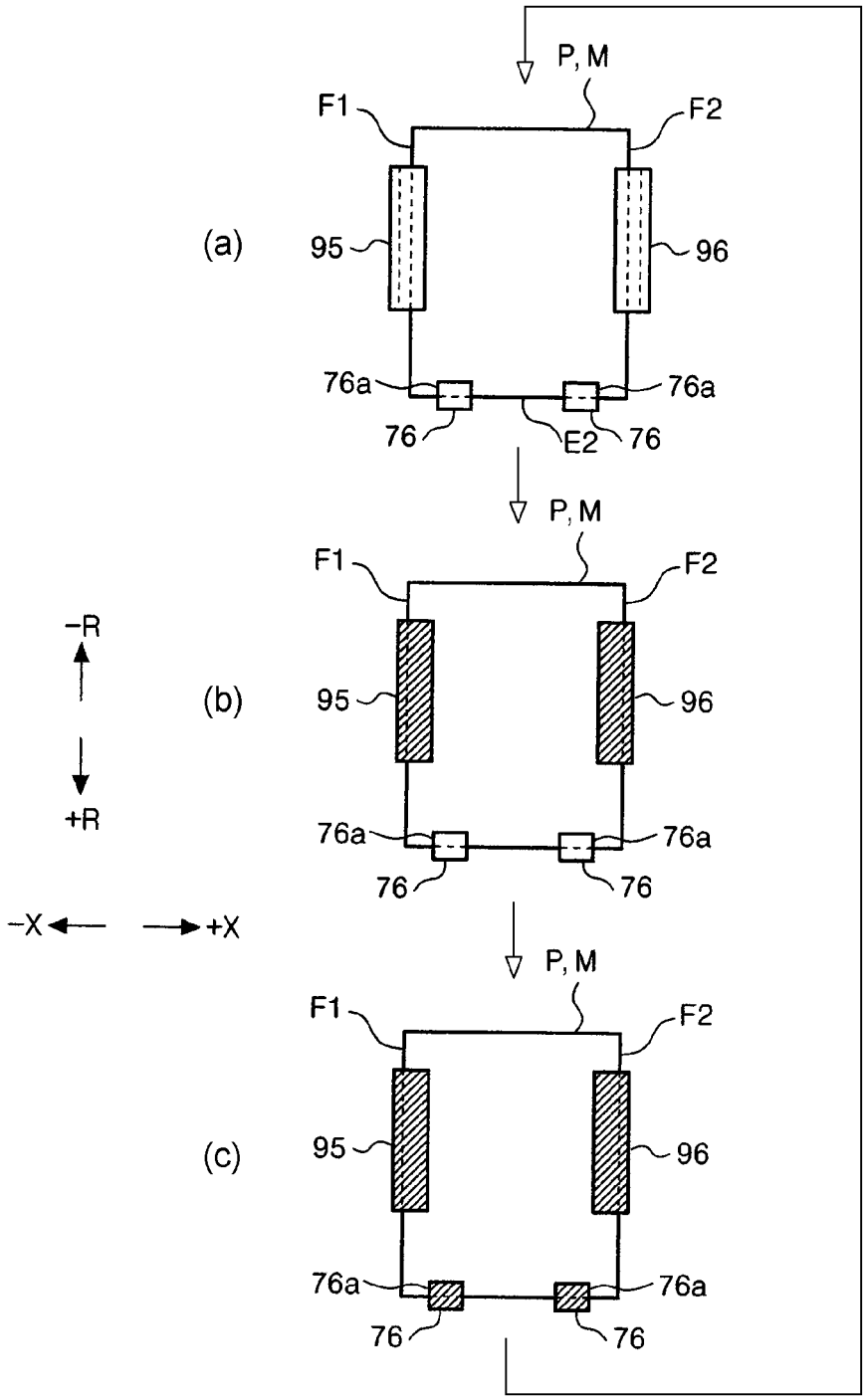
FIG. 9 is a diagram illustrating an operation of aligning portions and the side guides.

The first side guide 95 and the second side guide 96 are configured to be displaced from an aligning position (states (b) and (c) in FIG. 9) at which the edges F1 and F2 of the mediums P in the width direction are aligned by displacing the first side guide 95 and the second side guide 96 in directions approaching each other and by abutting the first side guide 95 and the second side guide 96 against the edges F1 and F2 of the mediums P stacked on the stacking portion 71 to a separated position (state (a) in FIG. 9) at which the first side guide 95 and the second side guide 96 are moved, with respect to the aligning position, away from the edges F1 and F2. Note that in FIG. 9, the first side guide 95 and the second side guide 96 displaced from the separated position to the aligning position are depicted in hatching, and the pressing portions 76*a* changed from the open state to the closed state are depicted in hatching.

The first side guide 95 and the second side guide 96 are controlled by the control unit 25 (see FIG. 1).

Figure 8:
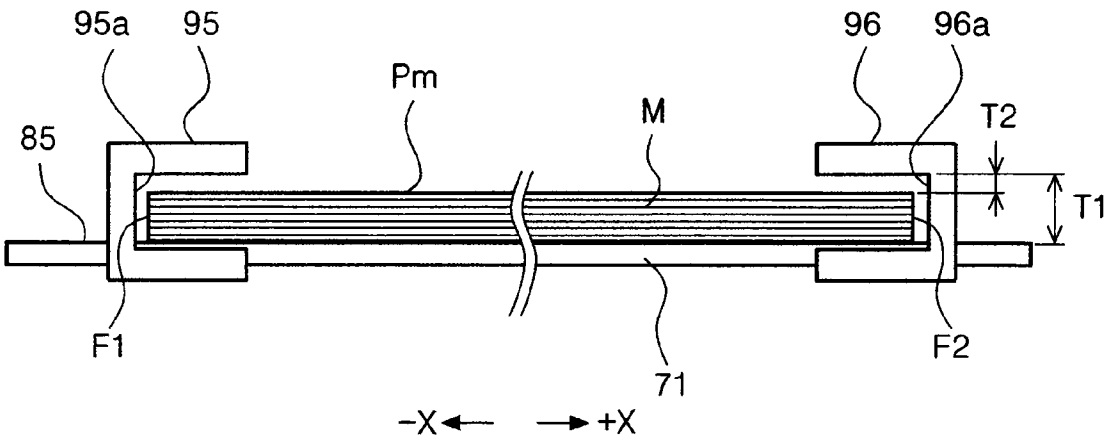
FIG. 8 is a diagram of side guides and a stacker portion viewed in a transport direction.

Note that in the present exemplary embodiment, the first side guide 95 is, as illustrated in FIG. 8, shaped so that a predetermined area of the medium P in the X-axis direction including the edge F1 enters therein when viewed in the transport direction and the second side guide 96, in a similar manner, is shaped so that a predetermined area of the medium P in the X-axis direction including the edge F2 enters therein. In FIG. 8, reference numeral 95*a* denotes a surface that abuts against the edge F1 of the medium P, and reference numeral 96*a* denotes a surface that abuts against the edge F2 of the medium P.

The stacking height of the stack of mediums M that can be stacked on the stacking portion 71 is limited by a distance T1 between the support surface 85 and each of the surfaces of the first side guide 95 and the second side guide 96 that opposes the support surface 85. Note that in the present exemplary embodiment, the distance between the surface of each pressing portion 76*a* that opposes the support surface 85 and the support surface 85 is also the same as the distance T1 when the pressing portions 76*a* are in the open state.

Note that as illustrated in FIG. 7, various paddles constituting the paddle group are each provided in a plural number at appropriate intervals in the width direction of the medium. In the present exemplary embodiment, four first paddles 81 are provided in the width direction of the medium, and two second paddles 82 are provided in the width direction of the medium. Furthermore, four first auxiliary paddles 83 and four second auxiliary paddles 84 are provided in the width direction of the medium. Since the installed number of second paddles 82 is smaller than the installed number of the first paddles 81, excessive transport of the medium with the second paddle 82 can be suppressed.

Note that in the present exemplary embodiment, four aligning portions 76 and four pressing portions 76*a* are provided in the width direction of the medium. Opening portions 71*a* are provided in the stacking portion 71 in a direction in which the aligning portions 76 move. The aligning portions 76 and the pressing portions 76*a* are disposed inside the opening portions 71*a*. Since the medium P cannot be supported at where the opening portions 71*a* are located, each paddle is disposed at a position avoiding the opening portion 71*a*.

In FIG. 7, a straight line CL depicts a center position in the X-axis direction or in the width direction of the medium. The paddles are, in the width direction of the medium, disposed at left and right symmetrical positions with respect to the center line CL.

In FIG. 7, reference numeral 91 is a motor that is a power source of a rotation shaft 81*a* or the first paddles 81, reference numeral 92 is a motor that is a power source of rotation shafts 82*a*, 83*a*, and 84*a*, or the second paddles 82, the first auxiliary paddles 83, and the second auxiliary paddles 84, and reference numeral 94 is a motive power transmitting portion that transmits driving force from a second motor 92 to the rotation shafts 82*a*, 83*a*, and 84*a*.

The binding mechanism 72 that binds the stack of mediums M, which are stacked on the stacking portion 71, at a predetermined position in the transport direction +R is provided downstream of a merging position G in FIG. 2. The binding position according to the present exemplary embodiment is a center portion C of the stack of mediums M, which is stacked on the stacking portion 71, in the transport direction +R.

The binding mechanism 72 is, for example, a stapler and binds the stack of mediums M with binding portions 72*a*, which are an example of binding members. A plurality of binding portions 72*a* are provided at intervals in the X-axis direction, which is the width direction of the medium P. As described above, the binding mechanism 72 is configured to bind the stack of mediums M at the binding position, which is the center portion C of the stack of mediums M in the transport direction.

The pair of folding rollers 73 are provided downstream of the binding mechanism 72. The opposing surface 86 is open at a position corresponding to a nip position N of the pair of folding rollers 73, and an entering path 78 of the stack of mediums M from the stacking portion 71 to the pair of folding rollers 73 is formed. In the entering path 78, an inclined surface that invites the center portion C, which is the binding position of the stack of mediums M, from the stacking portion 71 to the nip position N is formed in an entry hole in the opposing surface 86.

Figure 3:
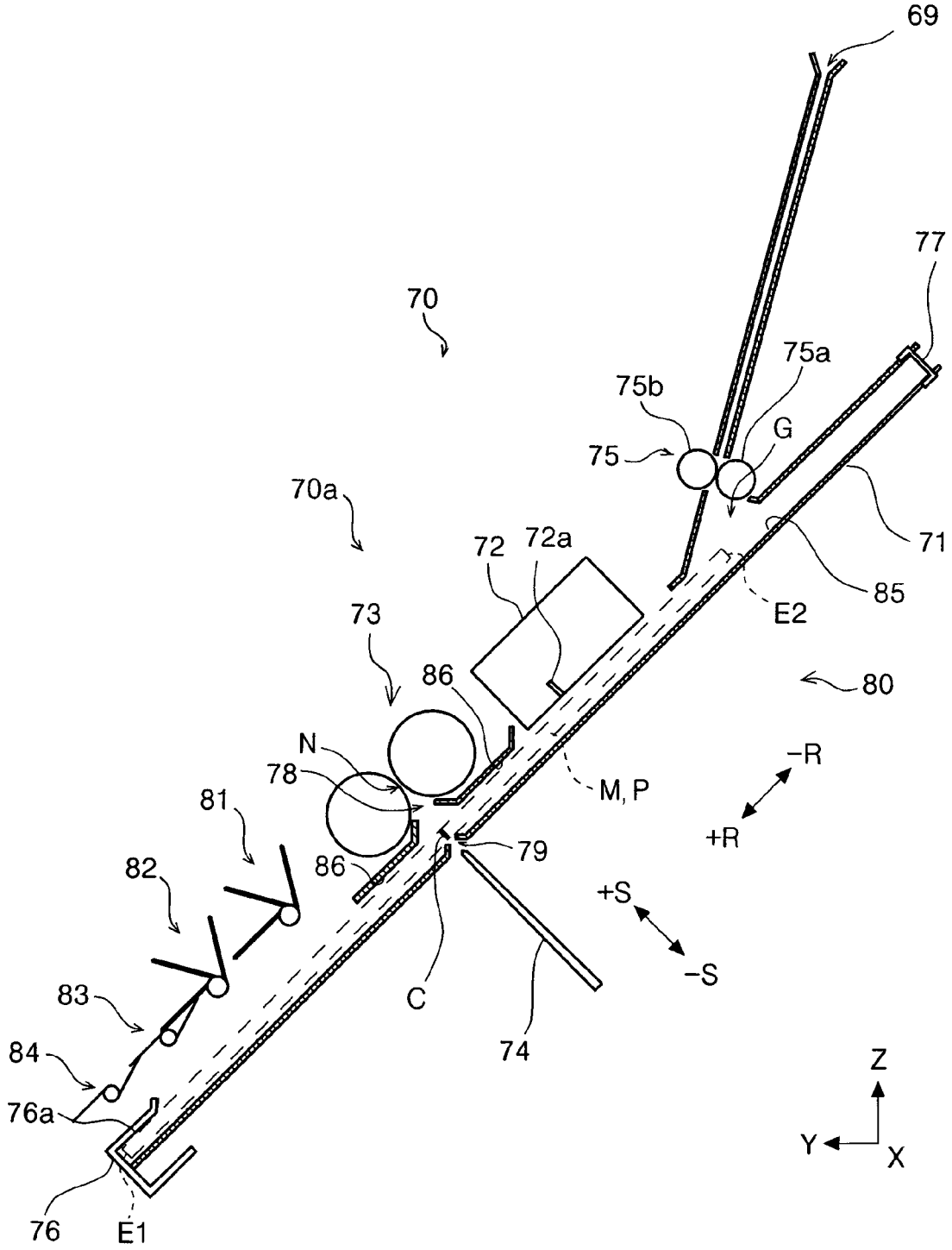
FIG. 3 is a side view of the saddle stitching and folding mechanism.
Figure 4:
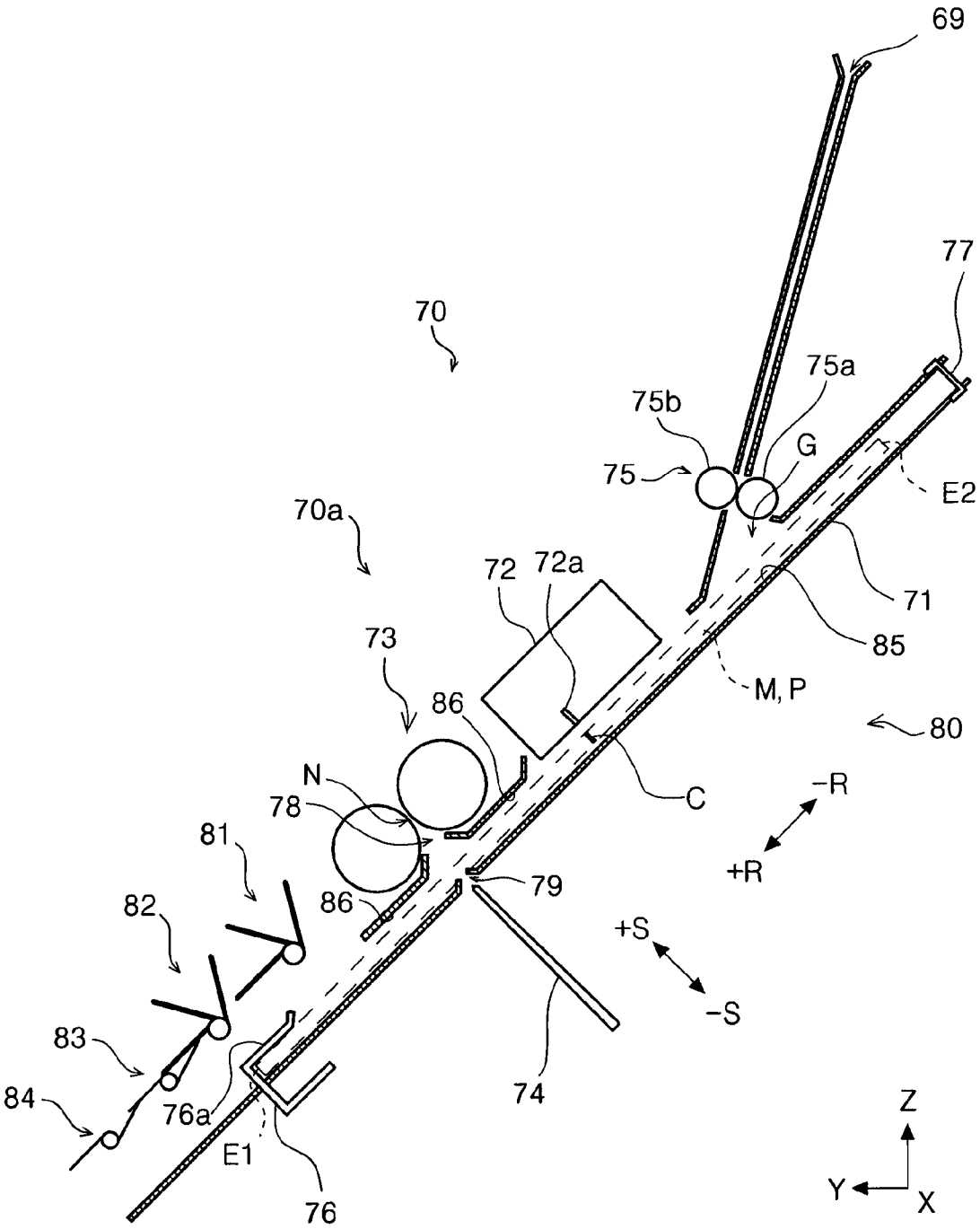
FIG. 4 is a side view of the saddle stitching and folding mechanism.
Figure 5:
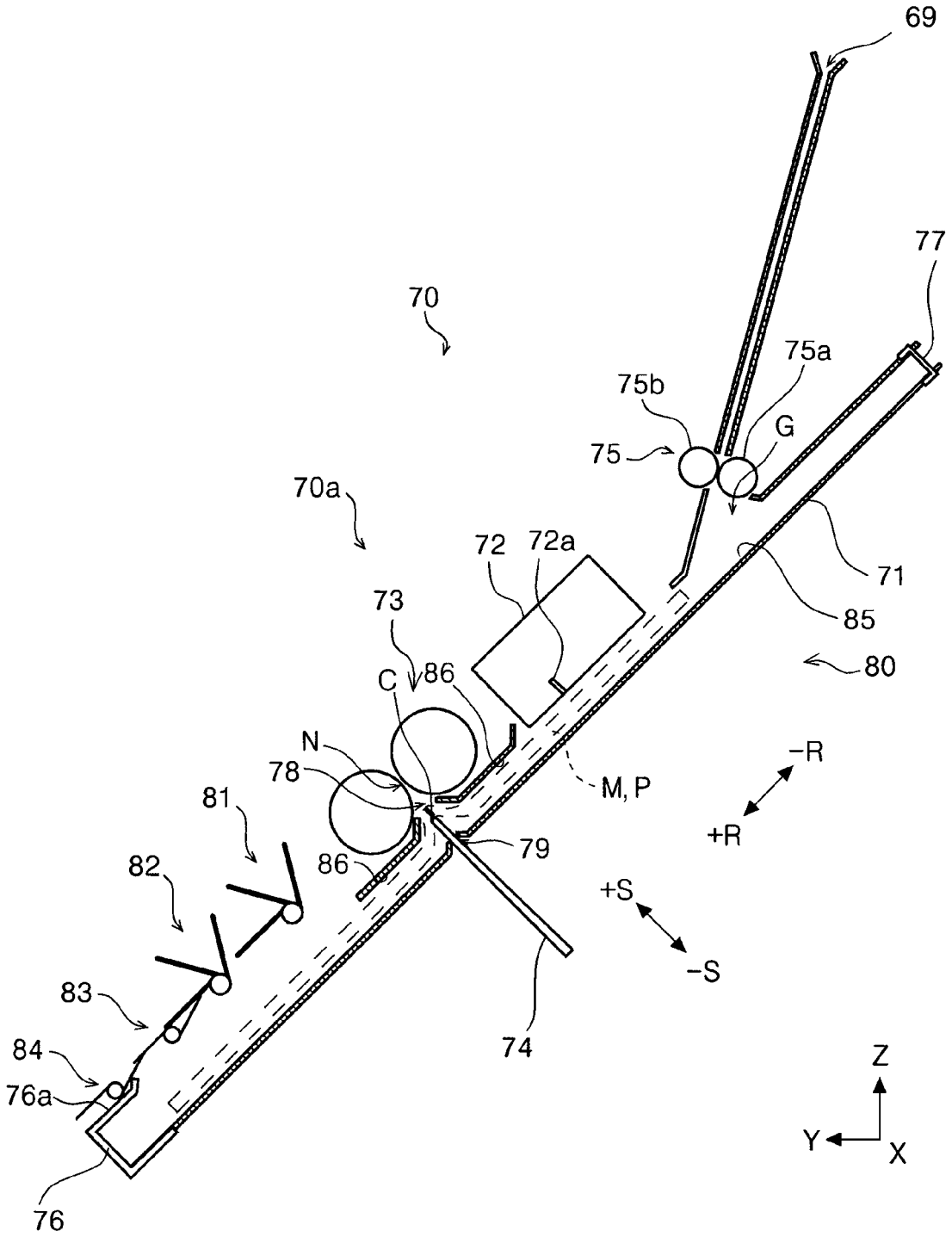
FIG. 5 is a side view of the saddle stitching and folding mechanism.

A blade 74 configured to switch between a retracted state illustrated in FIGS. 2 to 4 and 6 in which the blade 74 is retracted from the stacking portion 71, and an advanced state illustrated in FIG. 5 in which the blade 74 is advanced with respect to the binding position of the stack of mediums M stacked on the stacking portion 71 is provided on the opposite side of the pair of folding rollers 73 with respect to the stacking portion 71. Reference numeral 79 is a hole portion 79 provided in the support surface 85. The blade 74 is configured to pass through the hole portion 79.

Regarding Transport of Medium During Saddle Stitching

Referring next to FIGS. 2 to 8, a basic flow in the second unit 6 in which the mediums P are transported, in which saddle stitching is performed, and in which the mediums P are discharged will be described.

In a state before the medium P is sent to the stacking portion 71, in other words, in a standby state, the pressing portions 76*a* are in the closed state, and the first side guide 95 and the second side guide 96 are at the aligning position (the state (c) in FIG. 9). With the above, disarrangement in the alignment of the mediums P that have already been mounted on the stacking portion 71, in other words, disarrangement in the alignment of the stack of mediums M is suppressed. Note that hereinafter, when there is no need to distinguish between the first side guide 95 and the second side guide 96, the first side guide 95 and the second side guide 96 will be referred to as a "pair of side guides" for convenience sake.

Furthermore, before the first medium P is sent to the stacking portion 71, a state illustrated in FIG. 2 in which the paddle group is stopped at a phase not in contact with the medium P is maintained.

When the medium P is sent to the stacking portion 71, the pressing portions 76*a* are switched from the closed state to the open state, and the pair of side guides are displaced from the aligning position to the separated position (the state (a) in FIG. 9).

Furthermore, when the medium P that has been sent to the stacking portion 71 is the first medium P, the paddle group is controlled to start rotating at a timing at which the medium P is sent to the stacking portion 71 with the pair of feed rollers 75 (see FIG. 2). After the above, the paddle group continues to rotate until the last medium P is sent to the stacking portion 71 and until the stack of mediums M is discharged by the pair of folding rollers 73 after saddle stitching has been completed.

Referring to FIG. 2, the medium P that is sent to the stacking portion 71 moves towards the aligning portions 76 by its own weight and the downstream end E1 is abutted against the aligning portions 76 by rotation of the paddle group.

FIG. 2 illustrates a state in which the plurality of mediums P overlapping each other on the stacking portion 71 are stacked as the stack of mediums M.

Note that when the medium P is received in the stacking portion 71, each aligning portion 76 is, as illustrated in FIG. 2, disposed so that a distance from the merging position G between the transport path 69 and the stacking portion 71 to the aligning portion 76 is longer than the length of the medium P. With the above, the medium P is received in the stacking portion 71 without the upstream edge E2 of the medium P transported through the transport path 69 remaining in the transport path 69. The positions of the aligning portions 76 in the transport direction +R of the stacking portion 71 can be changed according to the size of the medium P.

Furthermore, at or after the timing at which the downstream edge E1 of the medium P is assumed to have reached the aligning portions 76, first, the pair of side guides are displaced from the separated position to the aligning position (the state (b) in FIG. 9). Subsequently, the pressing portions 76*a* are switched from the open state to the closed state (the state (c) in FIG. 9, and FIG. 3).

Transitioning of the states of the pair of side guides and the pressing portions 76*a* are repeated in the order of the state (a), the state (b), and the state (c) illustrated in FIG. 9 until the last medium P is stacked on the stacking portion 71.

Subsequently, when the last medium P has been stacked on the stacking portion 71, binding that binds, with the binding portions 72*a*, the center portion C of the stack of mediums M in the transport direction +R is performed. At the point when the transportation of the mediums P to the stacking portion 71 through the transport path 69 has been completed, as illustrated in FIG. 3, the position of the center portion C is deviated from the positions of the binding portions 72*a*; accordingly, as illustrated in FIG. 4, the aligning portions 76 are moved in the direction −R so that the center portion C of the stack of mediums M are disposed at a position that opposes the binding portions 72*a*. Furthermore, the abutting portions 77 are moved in the direction +R so that the upstream edge E2 of the stack of mediums M is abutted thereagainst. The downstream edge E1 and the upstream edge E2 of the stack of mediums M are aligned with the aligning portions 76 and the abutting portions 77, and the center portion C of the stack of mediums M is bound with the binding portions 72*a*.

After the stack of mediums M is bound with the binding portions 72*a*, the pair of side guides are displaced from the aligning position to the separated position and the pressing portions 76*a* are switched from the closed state to the open state. Subsequently, as illustrated in the change from FIG. 4 to FIG. 2, the aligning portions 76 are moved in the direction +R and the stack of mediums M is moved so that the bound center portion C is disposed at a position opposing the nip position N of the pair of folding rollers 73. By only moving the aligning portions 76 in the direction +R while maintaining the state in which the stack of mediums M is in contact with the aligning portions 76 by its own weight, the stack of mediums M can be moved in the direction +R. Note that the abutting portions 77 can be moved in the direction +R to maintain the state in which the upstream edge E2 of the stack of mediums M is in contact with the aligning portions 76.

Subsequently, when the center portion C of the stack of mediums M is disposed at a position that opposes the nip position N of the pair of folding rollers 73, as illustrated in FIG. 5, the blade 74 is advanced in a direction +S and the center portion C is bent towards the pair of folding rollers 73. The bent center portion C of the stack of mediums M passes through the entering path 78 and the stack of mediums M is moved towards the nip position N of the pair of folding rollers 73.

Figure 6:
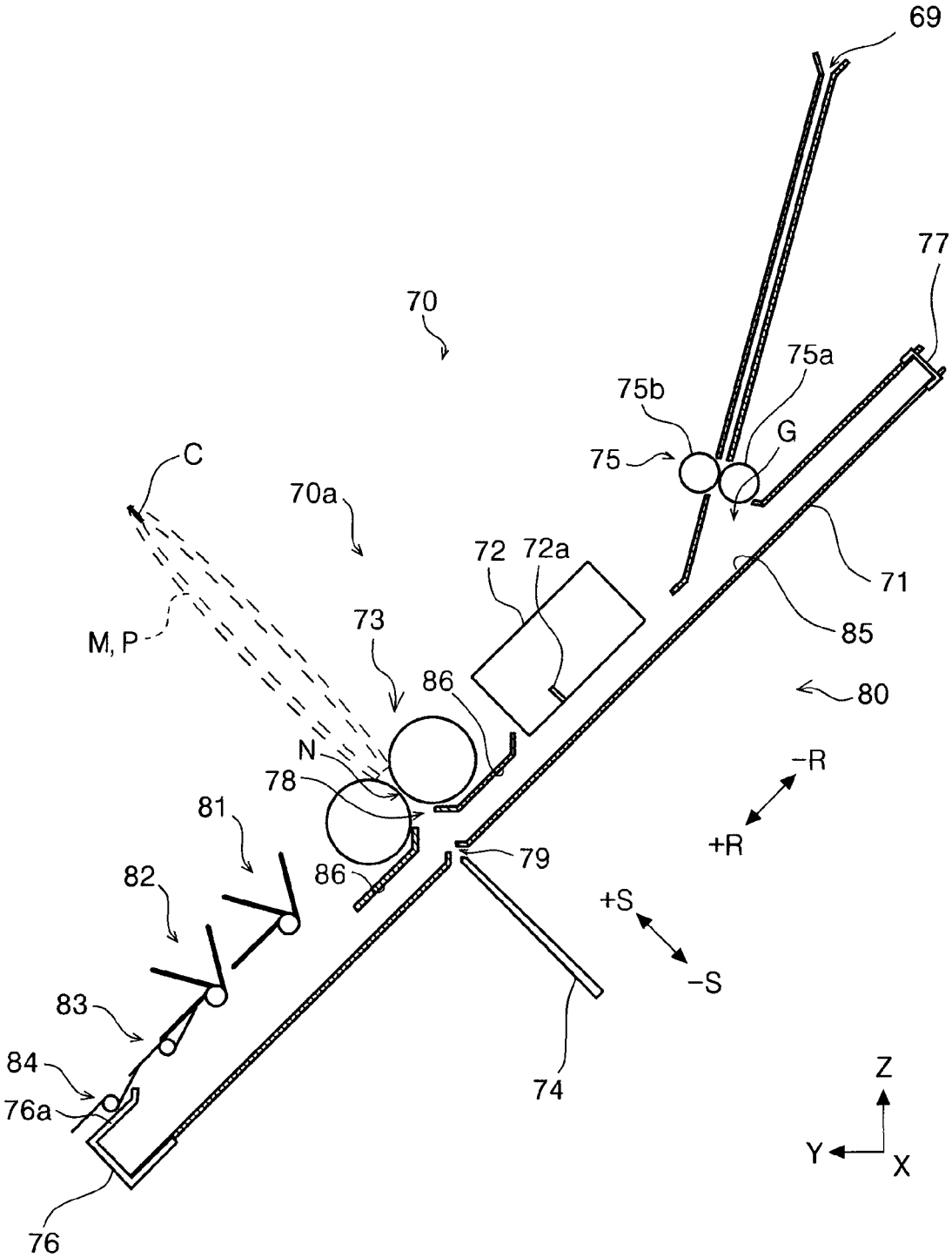
FIG. 6 is a side view of the saddle stitching and folding mechanism.

When the center portion C of the stack of mediums M becomes nipped by the pair of folding rollers 73, the pair of folding rollers 73 rotate, and as illustrated in FIG. 6, the stack of mediums M is folded at the center portion C by the nip pressure of the pair of folding rollers 73 and is discharged towards the second tray 65 (see FIG. 1).

Furthermore, after the center portion C is nipped by the pair of folding rollers 73, the aligning portions 76 move in the direction +R and return to the state in FIG. 2 in order to prepare for the reception of the next medium P in the stacking portion 71.

Note that a crease forming member that adds a crease to the center portion C of the medium P can be provided in the transport path 69. By creasing the center portion C, which becomes the position folded by the pair of folding rollers 73, folding of the stack of mediums M at the center portion C is facilitated.

Regarding Operations of First Side Guide, Second Side Guide, and Pressing Portions Referring subsequently to FIGS. 10 and 11, operations of the pair of side guides and the pressing portions 76*a* will be described in detail.

First, an issue that arises when the medium P is mounted on the stacking portion 71 will be described with reference to FIG. 2. As described above, that basic operation of the pressing portions 76*a* is, when in a state waiting for the medium P to be sent to the stacking portion 71, the pressing portions 76*a* takes a closed state (the first state), and when the medium P is sent to the stacking portion 71, the pressing portions 76*a* are switched from the closed state to the open state (the second state) and, subsequently, are returned to closed state from the open state.

Note that when the sliding between the mediums are insufficient, as is the case, in particular, in which ink jet printing is performed and the frictional coefficient between the mediums are large, there are cases in which the downstream edge E1 of the latest mounted medium P does not reach the aligning portions 76 and stops at an inappropriate position. However, in such cases as well, there are cases in which the medium P that has stopped at the inappropriate position is moved in the transport direction +R by the succeeding medium P and the downstream edge E1 of the medium P that has stopped at the inappropriate position reaches the aligning portions 76.

However, such an action cannot be expected to happen in the last medium P of the plurality of mediums P mounted on the stacking portion 71. Accordingly, saddle stitching may be performed on the stack of mediums M while the stack of mediums M is not aligned in an appropriate manner.

Figure 10:
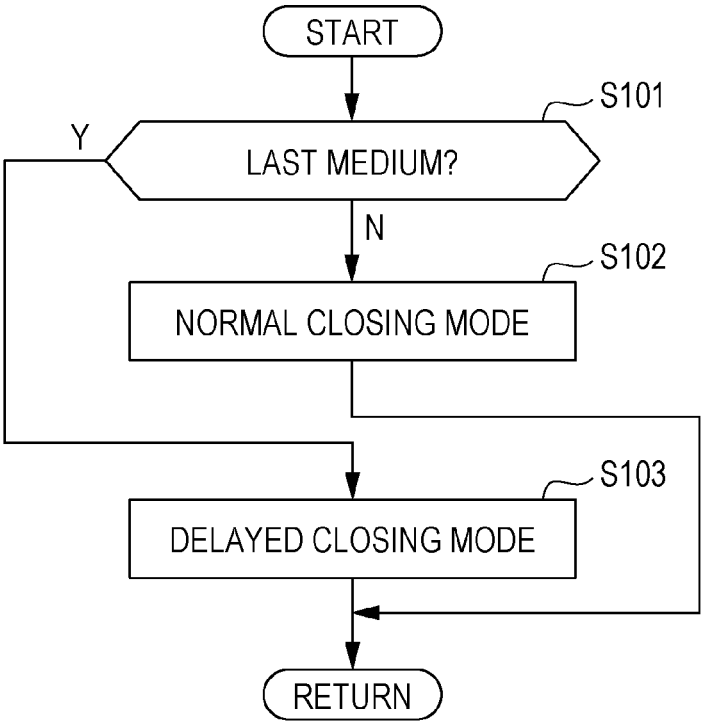
FIG. 10 is a flowchart illustrating control of the aligning portions and the side guides.
Figure 11:
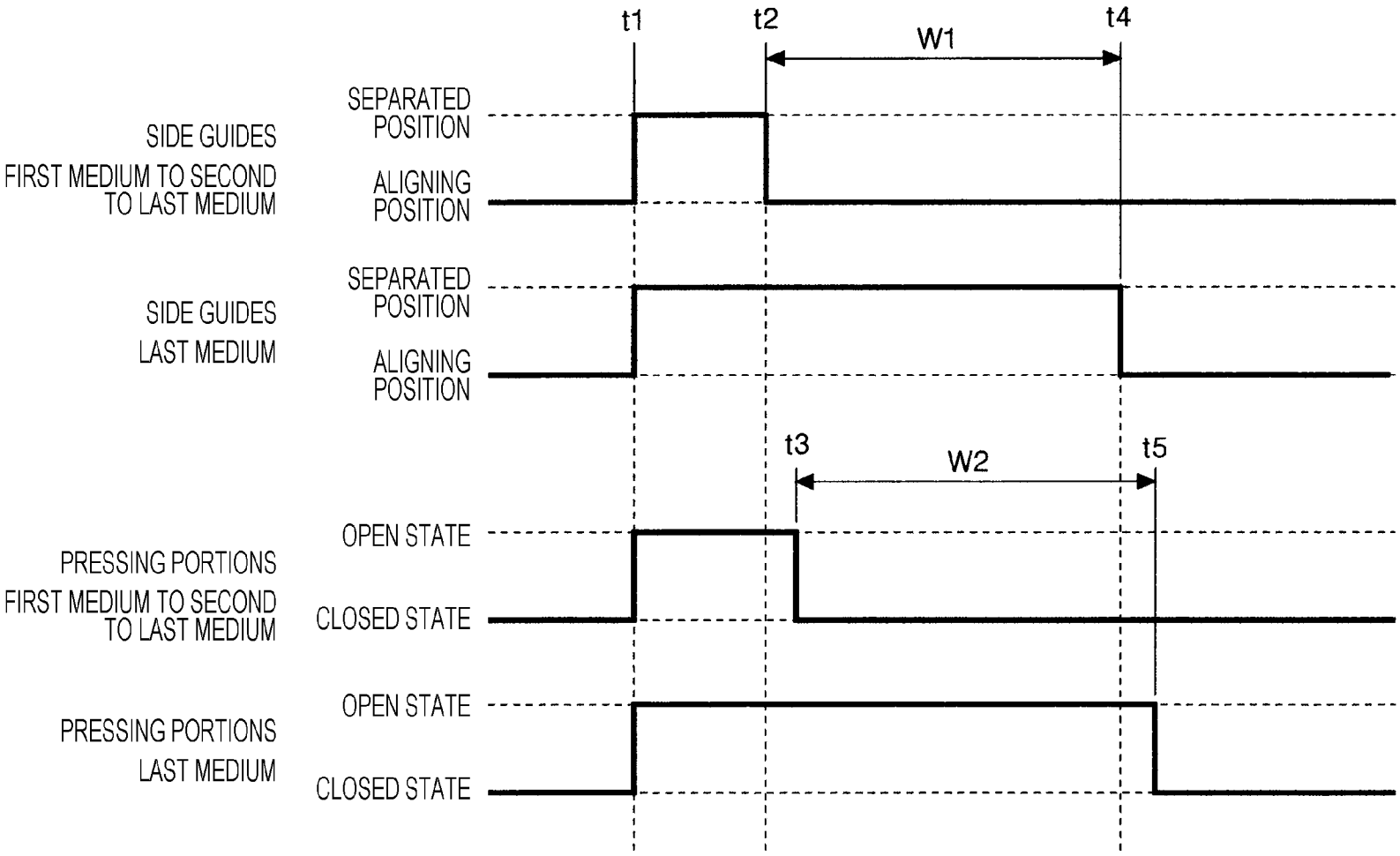
FIG. 11 illustrates timing charts illustrating operations of the aligning portions and the side guides.

The control illustrated in FIGS. 10 and 11 is executed to resolve such an issue.

In FIG. 10, the control unit 25 (see FIG. 1) determines whether the medium P sent to the stacking portion 71 is the last medium P (step S101), and if the medium P is not the last medium P (No in step S101), selects a normal closing mode (step S102) and if the medium P is the last medium P (Yes in step S101), selects a delayed closing mode (step S103).

Referring to FIG. 11, the normal closing mode and the delayed closing mode will be described in detail.

As described above, while waiting for the medium P to be sent to the stacking portion 71, the pair of side guides are at the aligning position and the pressing portions 76*a* are in a closed state. Furthermore, when the medium P is sent to the stacking portion 71, the pair of side guides are displaced from the aligning position to the separated position, and the pressing portions 76*a* are switched from the closed state to the open state. A timing at which the pair of side guides are displaced from the aligning position to the separated position is the same as a timing (timing t1) at which the pressing portions 76*a* are switched from the closed state to the open state.

Furthermore, when the medium P is sent to the stacking portion 71, first, the pair of side guides return to the aligning position from the separated position and, subsequently, the pressing portions 76*a* return to the closed state from the open state. With the above, the pressing portions 76*a* do not impede the aligning of the mediums P by the pair of side guides.

Furthermore, in the present exemplary embodiment, when the last medium P is mounted on the stacking portion 71, the pressing portions 76*a* are controlled so that the timing to return to the closed state from the open state is delayed with respect to the timing at which the pressing portions 76*a* are returned to the closed state from the open state when the medium P before the last medium P is mounted on the stacking portion 71. In FIG. 11, the chart for "first medium to second to last medium" illustrates the normal closing mode, and the chart for "last medium" illustrates the delayed closing mode.

In the normal closing mode, the timing at which the pressing portions 76*a* return to the closed state from the open state is timing t3 in FIG. 11, and in the delayed closing mode, the timing at which the pressing portions 76*a* return to the closed state from the open state is timing t5 in FIG. 11. The time between timing t3 and timing t5 is a delayed time W2.

With the above, the downstream edge E1 of the last medium P can reach the aligning portions in a more reliable manner and, ultimately, a more appropriate aligning result can be obtained.

Furthermore, compared with when the delayed closing mode is applied to all of the mediums P mounted on the stacking portion 71, a decrease in the throughput can be suppressed.

Furthermore, in a similar manner, when the last medium P is mounted on the stacking portion 71, the pair of side guides are controlled so that the timing to return to the aligning position from the separated position is delayed with respect to the timing at which the pair of side guides are returned to the aligning position from the separated position when the medium P before the last medium P is mounted on the stacking portion 71.

In the normal closing mode, the timing at which the side guides return to the aligning position from the separated position is timing t2 in FIG. 11, and in the delayed closing mode, the timing at which the side guides return to the aligning position from the separated position is timing t4 in FIG. 11. The time between timing t2 and timing t4 is a delayed time W1.

With the above, the side guides can align the edges of the mediums P in the width direction while the downstream edge E1 of the last medium P has reached the aligning portions 76 in a more reliable manner and, ultimately, a more appropriate aligning result can be obtained.

Furthermore, it is also suitable for the timings (timings t3 and t5) at which the pressing portions 76*a* return to the closed state from the open state, and the timings (timings t2 and t4) at which the side guides return to the aligning position from the separated position are controlled according to the conditions in which the mediums P are sent to the stacking portion 71. With the above, the downstream edges E1 of the mediums P can reach the aligning portions 76 in a more reliable manner and, ultimately, a more appropriate aligning result can be obtained.

For example, when the frictional coefficient between the mediums P is high, the downstream edge E1 of the last medium P does not easily reach the aligning portions 76; accordingly, suitably, the delayed times W1 and W2 described above are extended for a second medium P2 in which the frictional coefficient between the mediums P is higher than that of a first medium P1.

Furthermore, when the mediums P become swollen, for example, since the gap above a medium Pm mounted last, in other words, gap T2 in FIG. 8 becomes small, it will be difficult for the downstream edge E1 of the last medium Pm to reach the aligning portions 76. Accordingly, when the mediums P are sent to the second unit 6 under a second condition in which the swelling of the mediums P is more prominent than when under a first condition, suitably, the delayed times W1 and W2 described above are extended.

Note that swelling of the medium P is swelling that occurs in a case in which, for example, the medium P is a sheet of paper and the ink is a liquid, when the sheet of paper absorbs the ink. The swelling of the medium P changes depending on the type of paper, the amount of ink absorbed in the paper, the temperature, the humidity, the length of drying time in the drying portion 50 (see FIG. 1), and the like.

Specifically, when with plain paper in which the sheet is constituted of a single layer, the swelling at the time when the sheet is sent into the second unit 6 is more prominent than when with exclusive paper in which the sheet is constituted of a plurality of layers.

Furthermore, when the amount of discharged ink is a second amount that is larger than a first amount, the swelling at the time when the sheet is sent into the second unit 6 is prominent compared with when with the first amount.

Furthermore, when the drying time in the drying portion 50 (see FIG. 1) is a second time that is shorter than a first time, the swelling at the time when the sheet is sent into the second unit 6 is prominent compared with when with the first time.

Furthermore, when the humidity is a second humidity that is higher than a first humidity, the swelling at the time when the sheet is sent into the second unit 6 is prominent compared with when with the first humidity.

Accordingly, when the mediums P are sent to the second unit 6 under the second condition in which the swelling of the mediums P is more prominent than when under a first condition, a more suitable aligning result can be obtained by extending the delayed times W1 and W2 described above.

Note that in the exemplary embodiment described above, the delayed closing mode is applied to only the last medium P; however, the application of the delayed closing mode may be started at a medium P before the last medium P. Furthermore, in so doing, as the mounting of the mediums P on the stacking portion 71 proceeds, the delayed times W1 and W2 may be increased.

Note that the intermediate unit 3 and the first unit 5 may be omitted from the recording system 1. Furthermore, in so doing, the recording unit 2 and the second unit 6 may be individual units or the recording unit 2 and the second unit 6 may be integrated. In other words, the recording system may be configured inside a single housing including the line head 20 and the saddle stitching and folding mechanism 70.

As described above, in the present specification, the recording system may be either a collection of individual units or a single unit configuration.

Note that the present disclosure is not limited to the exemplary embodiments described above and various modifications can be made within the scope of the disclosure stated in the claims, which are, naturally, also included in the scope of the present disclosure.

What is claimed is:

1. A medium transporting apparatus comprising:

a feeding member configured to transport a medium;

a mounting portion that includes a support surface configured to support and stack the medium transported from the feeding member, the support surface being in an inclined position in which a downstream portion thereof is oriented downwards in a transport direction; and a medium presser configured to switch between a first state for pressing the medium against the support surface at a predetermined upstream area in the transport direction from a downstream edge of the medium, and a second state for being away from the support surface with respect to the first state, wherein the medium presser is configured to take the first state in waiting for the medium to be sent to the mounting portion, switch to the second state from the first state when the medium is sent to the mounting portion, and return to the first state from the second state after the medium is sent to the mounting portion, and the medium presser is configured to delay a timing to return to the first state for a last medium of a plurality of mediums mounted on the mounting portion with respect to a timing to return to the first state for a second medium from the last medium.

2. The medium transporting apparatus according to claim 1, further comprising:

a first side guide that opposes a first edge of the medium, which is mounted on the mounting portion, in a width direction that is a direction intersecting the transport direction; and a second side guide that opposes a second edge of the medium, wherein the first side guide and the second side guide are configured to be displaced from an aligning position that aligns the edges of the medium in the width direction to a separated position in which the first side guide and the second side guide are, with respect to the aligning position, away from the edges of the medium, when in the state waiting for the medium to be sent to the mounting portion, the first side guide and the second side guide are in the aligning position, and when the medium is sent to the mounting portion, the first side guide and the second side guide are displaced to the separated position from the aligning position and, subsequently, are returned to the aligning position from the separated position, and in the case in which the plurality of mediums are mounted on the mounting portion, when the last medium is mounted on the mounting portion, a timing at which the first side guide and the second side guide are returned to the aligning position from the separated position is delayed with respect to a timing at which the first side guide and the second side guide are returned to the aligning position from the separated position when the medium before the last medium is mounted on the mounting portion.

3. The medium transporting apparatus according to claim 2, wherein the medium presser returns to the first state from the second state after the first side guide and the second side guide return to the aligning position from the separated position.

4. The medium transporting apparatus according to claim 3, further comprising:

a medium aligner that aligns downstream edges of the mediums, which are mounted on the mounting portion, in the transport direction; and a paddle that is positioned between the feeding member and the medium aligner in the transport direction and that is disposed so as to oppose the support surface, the paddle moving the medium towards the aligning portion by rotation thereof while being in contact with the medium.

5. The medium transporting apparatus according to claim 4, wherein the timing at which the medium presser returns to the first state from the second state and the timing at which the first side guide and the second side guide return to the aligning position from the separated position are controlled according to a condition in which the medium is sent to the mounting portion.

6. A processing apparatus comprising:

the medium transporting apparatus according to claim 5, and a medium presser that performs a process on a medium mounted on the mounting portion.

7. A recording system comprising:

a recording unit that performs recording on a medium; and the processing apparatus according to claim 6 that receives the medium and performs a process on the medium on which recording was performed with the recording unit.

8. The medium transporting apparatus according to claim 2, further comprising:

medium aligner that aligns downstream edges of the mediums, which are mounted on the mounting portion, in the transport direction; and a paddle that is positioned between the feeding member and the medium aligner in the transport direction and that is disposed so as to oppose the support surface, the paddle moving the medium towards the aligner by rotation thereof while being in contact with the medium.

9. The medium transporting apparatus according to claim 2, wherein the timing at which the medium presser returns to the first state from the second state and the timing at which the first side guide and the second side guide return to the aligning position from the separated position are controlled according to a condition in which the medium is sent to the mounting portion.

10. A processing apparatus comprising:

the medium transporting apparatus according to claim 1, and a medium presser that performs a process on a medium mounted on the mounting portion.

11. A recording system comprising:

a recording unit that performs recording on a medium; and the processing apparatus according to claim 10 that receives the medium and performs a process on the medium on which recording was performed with the recording unit.

12. The medium transporting apparatus according to claim 1, further comprising:

a control portion, wherein the control portion causes the medium presser to take the first state in waiting for the medium to be sent to the mounting portion, to switch to the second state from the first state when the medium is sent to the mounting portion, and return to the first state from the second state after the medium is sent to the mounting portion, and the control portion delays a timing of the medium presser to return to the first state for a last medium of a plurality of mediums mounted on the mounting portion with respect to a timing of the pressing portion to return to the first state for a second medium from the last medium.

13. A method for transporting a plurality of media in a medium transporting apparatus, the method comprising:

transporting each of the plurality of media from a feeding member to a mounting portion that includes a support surface;

supporting and stacking the media transported from the feeding member, the support surface being in an inclined position in which a downstream portion thereof is oriented downwards in a transport direction;

switching a medium presser between a first state and a second state, the first state of the medium presser being in which the medium presser presses the medium against the support surface at a predetermined upstream area in the transport direction from a downstream edge of the medium, and the second state of the medium presser being in which the medium presser is away from the support surface with respect to the first state, wherein for each of at least some of the received media, the medium presser takes the first state in waiting for the medium to be sent to the mounting portion, switches to the second state from the first state when the medium is sent to the mounting portion, and return to the first state from the second state after the medium is sent to the mounting portion, and the medium presser is configured to delay a timing to return to the first state for a last medium of the plurality of media mounted on the mounting portion with respect to a timing to return to the first state for a second medium from the last medium.

14. The method according to claim 13, the medium transporting apparatus further comprising a first side guide that opposes a first edge of the medium, which is mounted on the mounting portion, in a width direction that is a direction intersecting the transport direction, and a second guide that opposes a second edge of the medium, the method further comprising:

displacing the first side guide and the second side guide from an aligning position, where the aligning position aligns the edges of the medium in the width direction to a separated position in which the first side guide and the second side guide are, with respect to the aligning position, away from the edges of the medium, wherein when waiting for the medium to be sent to the mounting portion, the first side guide and the second side guide are in the aligning position, and when the medium is sent to the mounting portion, the first side guide and the second side guide are displaced to the separated position from the aligning position and, subsequently, are returned to the aligning position from the separated position, and in the case in which the plurality of mediums are mounted on the mounting portion, when the last medium is mounted on the mounting portion, a timing at which the first side guide and the second side guide are returned to the aligning position from the separated position is delayed with respect to a timing at which the first side guide and the second side guide are returned to the aligning position from the separated position when the medium before the last medium is mounted on the mounting portion.

* * * * *